United States Patent [19]

Rivers

[11] 4,343,650

[45] Aug. 10, 1982

[54] METAL BINDER IN COMPACTION OF METAL POWDERS

[75] Inventor: Ronald D. Rivers, Kokomo, Ind.

[73] Assignee: Cabot Corporation, Kokomo, Ind.

[21] Appl. No.: 143,405

[22] Filed: Apr. 25, 1980

[51] Int. Cl.[3] ..... B22F 3/00

[52] U.S. Cl. ..... 75/213; 75/251; 75/255; 264/111

[58] Field of Search ..... 75/213, 251, 255; 264/111

[56] References Cited

U.S. PATENT DOCUMENTS

| | | | |
|---|---|---|---|
| 2,372,696 | 4/1945 | Tholand | 75/213 |
| 3,418,106 | 12/1968 | Pierret | 75/213 |
| 3,453,105 | 7/1969 | Flaks et al. | 75/213 |
| 3,490,901 | 1/1970 | Hackisuka | 75/213 |
| 3,615,380 | 10/1971 | Fichte | 75/213 |
| 3,698,877 | 10/1972 | Motoyoshi | 75/213 |
| 3,832,156 | 8/1974 | Wilson et al. | 75/213 |
| 3,846,126 | 11/1974 | Foley et al. | 75/213 |
| 3,859,087 | 1/1975 | Backstrom | 75/213 |
| 3,934,179 | 1/1976 | Pierret | 75/213 |

*Primary Examiner*—Brooks H. Hunt

*Attorney, Agent, or Firm*—Jack Schuman; Joseph J. Phillips

[57] ABSTRACT

A method for improving the compaction characteristics of a substantially noncompactable metal powder comprising preparing a superalloy, for example, a nickel base alloy, minus a portion of at least one metal (i.e., 5 weight percent); atomizing the melt and milling it to a fine powder (i.e., about average Fisher size of 9.0 microns); blending an equal portion (i.e., about 5 weight percent) of, for example, carbonyl nickel into the milled powder; sinterbonding the mixture into a "cake" and then further processing as may be required to obtain the desired article. It is believed the "soft" carbonyl nickel acts as a binder for the prealloyed nickel-base alloy powder.

10 Claims, No Drawings

METAL BINDER IN COMPACTION OF METAL POWDERS

This invention relates to the manufacture of powder metallurgy articles, and, more specifically, to a method of producing finished powder metallurgy articles without the use of organic binders in normally noncompactable alloy powders. Metal powder prepared by the method of this invention has unique engineering properties.

In the art of powder metallurgy relating to this invention, there are three distinct methods of producing alloys and composite materials into powder metallurgy parts: METHOD I blending elemental metal powders to produce a final alloy; METHOD II mixing metal powders and metal compounds to produce bonded composites and METHOD III preparing a prealloyed powder to be processed into a finished alloy article. METHOD I is especially suited for relatively simple binary and ternary alloys, i.e., Ni-Cu and Ti-Al-V. METHOD II is especially suited for metal-ceramics and metal-bonded compounds, i.e., thoriated tungsten and cobalt-bonded tungsten carbide. METHOD III is especially suited for complex alloys (superalloys) for use in severe service conditions.

Each of these methods, as noted above, is especially suited for a specific application and/or alloy system. METHOD I and METHOD II, described above, generally require no special efforts to make the powders compactable when the powders are blended together. METHOD III, relating to prealloyed superalloys, is generally more difficult because each particle of the prealloyed powder is actually a miniature superalloy casting. The hardness and other inherent mechanical and physical properties of cast superalloys are especially resistant to the deformation and agglomeration characteristics as are required for metal powders to become readily compacted into articles. Because of this, prealloyed superalloys generally require additional complex processing together with the use of organic binders to effectively compact the powder into an article with sufficient green strength. Such binders include resins and waxes such as polyvinyl alcohol, cellulose, and similar organic materials.

This invention is principally concerned with METHOD III relating to the compaction of superalloy powders by an improved process and the metal powder made by the process of this invention.

The prior art provides a variety of methods to produce powder metallurgy articles. Many of the steps in the overall processing steps, as mentioned above, are found in prior art methods.

U.S. Pat. Nos. 3,914,507; 3,734,713 and 3,741,748 describe a process similar to Method II described above wherein platelets of metals are coated with disperoids by an attrition milling process.

U.S. Pat. No. 3,779,717 describes a method of mixing nickel carbonyl with tantalum scrap to obtain a master alloy having a high rate of solution in molten nickel.

U.S. Pat. No. 3,171,739 describes a method of adding carbonyl nickel into a melt of nickel-tungsten-chromium alloy to obtain a casting with improved resistance to lead oxide corrosion.

U.S. Pat. No. 2,936,229 discloses spray-welding alloy powders containing aluminum powder to improve the self-fluxing characteristics of the spray-welding alloy powders.

U.S. Pat. No. 3,723,092 discloses a process for making thoriated nickel by mixing thoria and carbonyl nickel powders and mechanically "alloy" the mixture in an attritor mill. Examples of more complex alloys are also discussed.

The prior art patents described above disclose various methods of making elemental metal additions to metal products. These methods do not provide a solution to the problem of compaction of superalloys.

All compositions, herein, are given in weight percent (w/o) unless otherwise stated.

The term "superalloy" as used herein may be defined as an alloy for use in severe service conditions, for example, comprising a nickel, iron or cobalt base and may also contain chromium, tungsten, molybdenum, and/or other elements, as exemplified by the alloys listed in Table 2.

The term "sinterbonding" as used herein describes the metallurgical bonding of a "soft" metal-bearing powder to a substantially noncompactable metal powder.

It is a principal object of this invention to provide a method of compaction of superalloy powders that simplifies processing and eliminates the need for organic binders.

It is another principal object of this invention to provide a metal powder with physical and/or mechanical properties equal or exceeding properties of organically bindered powders.

These and other objects and benefits are provided by this invention as described in this specification and claims. It was discovered that the objectives are obtained when producing an article by the following steps:

(1) Melt the basic alloy composition minus a portion (for example 5%) of at least one relatively soft element as required in the final alloy:

(2) Make powder from the melt and, if required, mill the powder to desired particle size:

(3) Add the withheld portion (for example 5%) in the form of a "soft" pure metal (i.e., metal carbonyl and blend):

(4) Sinterbond the blend (preferably in vacuum and about 2000° F. for 2 hours) into a cake:

(5) Crush cake to a convenient particle agglomerate size (i.e., −60 mesh):

(6) Add lubricant, if required, (for example 0.5% Acrawax C) and blend:

(7) Fashion the crushed powder into desired shape (i.e., cold pressing, etc.):

(8) Further process as may be required for desired article. Benefits of this invention are obtained in steps (1) and (3). The withholding of a portion of at least one relatively soft element during melting and the provision and metallurgical bonding of that portion (as "soft" metal) before compaction constitutes the gist of this invention. The sinterbonded powder, step 4 above, constitutes an article of this invention.

EXAMPLE I

An alloy was melted having an aim composition of 9 to 11% cobalt, 11.5 to 13.5% iron, 25 to 27% chromium, 2.1 to 2.7% carbon, 9 to 11% each of molybdenum and tungsten, up to 1% each of silicon and boron, up to 0.75% manganese and the balance nickel. Said melt composition was calculated to have 5% less nickel than required in the final alloy. The melt was atomized by an inert gas and screened to minus 30 mesh and then ball milled to an average Fisher size of 9.0 microns. The milled powder was thoroughly blended with 5% carbonyl nickel powder then sinterbonded into a "cake" in vacuum at 1950° F. for 2 hours. After cooling, the sinterbonded cake was crushed to minus 60 mesh agglomerates. The powder was then thoroughly blended with 0.5% atomized grade ACRAWAX C dry lubricant. The powder was then compacted in the form of test specimens for testing. The product of this example is identified as No. 208 powder.

An alloy identical in final composition to No. 208 powder was prepared as powder and processed by methods known in the art. The powder was organically bindered with polyvinyl alcohol. This powder was also similarly compacted in the form of test specimens and is identified as No. 208P powder.

Table 1 presents a comparison between No. 208 powder produced by this invention and No. 208P powder made by prior art method.

Table 1 shows the improved compactability of No. 208 powder compared to No. 208P powder. Note that the compactability of No. 208P powder at 50 Tsi (100,000 psi) is almost identical to the compactability of No. 208 powder at only 30 Tsi (60,000 psi).

The standard Hall Flow test shows that the flow characteristic of No. 208P is nil while the flow characteristic of No. 208 powder is within an acceptable working image. This feature improves the reproducibility of part size through more uniform die fill.

The transverse rupture green strength of 208 powder far exceeds the strength of 208P powder. Increases in the green strength and compactability of the process of this invention constitute a major improvement in the art of superalloy powder metallurgy. These major improvements in the art are realized without an anticipated reduction in sinterability characteristics. It would be expected that the substitution of a metal binder to replace an organic binder would increase the lower limit of sinterability range. However, test results shown in Table 1 show an unexpected improvement. The lower limit of sinterability (2170° F.) remains constant. This improvement is realized whether the powder is sintered in vacuum or hydrogen atmosphere.

Test results of sintered properties on No. 208 and No. 208P powders indicate both powders yield sintered products with practically identical physical properties. However, sintered products of No. 208 have much higher mechanical strengths as noted in Table 1.

Other advantages of the process yielding No. 208 powder over prior art No. 208P powder include:

(1) The cost of bindering No. 208 is about 40% less than the cost of bindering No. 208P.

(2) The rejection rate of scrap material was higher for No. 208P, probably because of the higher green strength of No. 208 powder.

(3) The handling of No. 208 is less dusty than the handling of No. 208P. This feature is helpful in meeting certain OSHA requirements.

(4) Segregation is no problem in No. 208 because the particles are metallurgically bonded and exist as uniformly blended agglomerates.

(5) The process of this invention appears to produce products essentially identical to prior art products in final form. The microstructure and X-Ray analysis indicated no difference between the two products.

The method of producing the initial prealloyed powder is not limited by the examples shown herein. The examples are described as the processes used in preparing the powders for the tests. The alloys were melted in an induction furnace and atomized in an inert gas atmosphere. Other means for preparing the initial powder material may be equally effective. Likewise, the initial powder need not be an alloy, and can be any substantially noncompactable metallic powder.

Through experimentation, it was found that crushed metal particles tend to compact more effectively than "as atomized" particles. For example, test specimens made of atomized −325 mesh metal powder generally will have lower strength values than test specimens of the same metal made by powder that was crushed to a similar −325 mesh from a larger particle size. To obtain optimum benefits from this invention, milled powders are preferred as initial material.

OTHER EXAMPLES

Table 2 lists the nominal composition of other alloys that were tested as examples of the process of this invention. These alloys are typical of superalloys that may be produced by the process of this invention.

The process of this invention was tested with a variety of test conditions. Table 3 present data obtained with the processing of Alloy N-6. The original melt was controlled to contain 5% less nickel than desired in the final alloy. Three batches of prealloyed and milled powders were tested (A, B, and C). The three batches were milled to contain −325 mesh particles at 51.7%, 69.7% and 83.8% or the equivalent of an average Fisher particle size of 11.6μ 7.9μ and 6.1μ respectively.

Each batch was then blended incorporating 5% elemental nickel powder (Carbonyl grade). The average particle size after blending was 10.5μ, 7.4μ and 5.7μ respectively.

Each of the batches was subsequently sinterbonded for two hours at three temperatures 1800° F., 1900° F., and 2000° F. The effect of the sinterbonding at various temperature is noted by the change in average particle size. For example, Batch A powder blended with 5% elemental powder had an average Fisher particle size of 10.5μ. After sinterbonding at 1800° F. for 2 hours the average Fisher particle size was 12.2μ with an apparent particle growth of 1.7μ.

The sinterbonded and crushed powders were pressed into test samples at 50 tons per square inch (100,000 psi). The test samples had green density values, in percent of theoretical density, as indicated in Table 3. The test samples were tested for green strength by means of the standard ASTM B528-76 Transverse Rupture Test. Testing was conducted at a load rate of 0.05 inch per inch.

Tables 3 through 7 contain data obtained from experimental testing of alloys listed in Table 2. Tables 4 through 7 present data obtained by similar testing as described above relating to Table 3.

It will be noted in the data presented in Example 1 and other examples, herein presented, that as a given powder is milled finer, the green strength of the compacted powder increases. It will also be noted, that as the sinterbonding temperature is increased, the green strength increases up to a temperature at which the "soft" metal is sufficiently alloyed to lose its ductility.

The significance of the "apparent particle growth" as shown in these data, is primarily to judge the degree of sinterbonding with any given alloy composition, milled size and elemental metal addition. Although an empirical number, it has been found that a given alloy milled to the same size and sinterbonded the same, will exhibit reasonably reproducible particle growth and green strength. It is, therefore, a useful process control data point.

It will be obvious to those skilled in the art, that the selection of powder processing parameters must include the desired sintering characteristics of the powder as well as the desired green strength level for the handling of the parts produced. The data in the Tables provide a basis for such parameters.

Other modifications within the scope of this invention may include a large variety of alloys. For example, copper base alloys or copper containing alloys may use copper powder as the "soft" metal.

Tables 5 and 6 additionally have data obtained from tests wherein 10 and 15% of the "soft" metal (cobalt) was withheld from the initial powder then added at the blending steps. These data tend to show that higher portions of "soft" metal blended into the powders provide higher strengths when higher strengths are desirable.

These data further suggest the effective range of "soft" metal portion may vary from about 1% up to the maximum content of that metal in the final alloy. Because of the higher costs of "pure" metals, economics, of course, suggest an upper limit of about 25% as an effective amount. Thus, the broad range is about 1% to the maximum content of the "soft" metal. A preferred range is about 1% to about 25%. Of course, it is understood that the actual effective content depends upon several possible conditions, for example, (1) the composition of the alloy, (2) the sinterability of the alloy, (3) the effectiveness of the "soft" metal, (4) the choice of "soft" metal depending upon availability, costs and other considerations.

Other modifications and variations may be made within the scope of this invention. For example, after the crushing step, the metal powder of this invention is suitable as a powder for use in metal coating operations such as plasma spray processing. The deposition of the powder on a substrate constitutes the compaction step.

Although specific embodiments of the present invention have been described in connection with the above examples, it should be understood that various other modifications can be made by those having ordinary skills in the metallurgical arts without departing from the spirit of the invention taught herein. Therefore, the scope of this invention should be measured solely by the appended claims.

TABLE 1

PROPERTY COMPARISON
No. 208 and 208P Powders

| | | No. 208P Powder | No. 208 Powder |
|---|---|---|---|
| COMPACTABILITY: | 30 TSI | 59.5 | 63.4 |
| (GREEN DENSITY, %) | 50 TSI | 63.6 | 68.9 |
| | 70 TSI | 66.2 | 72.4 |
| HALL FLOW, SECONDS/50G | | WNF* | 35–38 |
| GREEN STRENGTH: | 50 TSI | 300–800 PSI | 700–1200 PSI |
| SINTERABILITY: | | 2170–2260 | 2170–2260 |
| SINTERED PROPERTIES | | | |
| DENSITY, % | | 97.0–97.5 | 97.5–98.5 |
| HARDNESS, Rc** | | 48–50 | 48–50 |
| R. T. TENSILE, KSI*** | | 68.7 | 87.4 |
| TRANSVERSE RUPTURE, KSI | | 120.8 | 130.7 |

*WNF—WILL NOT FLOW
**Rc—ROCKWELL "C" SCALE
***R. T.—TENSILE, KSI ROOM TEMPERATURE TENSILE STRENGTH, 1000psi

TABLE 2

Composition of Alloys Tested in Weight Percent, W/O

| Alloy No. | Ni | Co | Fe | Si | Mn | Cr | Mo + W | W | C | B | Cb | Cu |
|---|---|---|---|---|---|---|---|---|---|---|---|---|
| N-6 | Bal | *5 | *3 | .8–1.2 | — | 27–31 | Mo + W | 5–7 | .8–1.4 | .4–.8 | | |
| 711 | Bal | 10–15 | 20–25 | .6–1.5 | *.8 | 25–30 | Mo + W | 8–16 | 2.5–3 | *1 | *.5 | *.5 |
| 106 | *3 | Bal | *3 | *1.5 | *1 | 27–31 | *1.5 | 3.5–5.5 | .9–1.4 | *1 | | |
| 103 | *3 | Bal | *3 | *1 | *1 | 29–33 | — | 11–14 | 2–1.7 | *1 | | |
| 587 | *3 | *3 | Bal | .5–1 | *.5 | 23–26 | 15–17 | | 2.6–3.1 | .5–.75 | | |
| 208 | Bal | 9–11 | 11.5–13.5 | *1.0 | *.75 | 25–27 | 9–11 | 9–11 | 2.1–2.7 | *1 | | |

*MAXIMUM
BALANCE INCLUDES IMPURITIES

TABLE 3

Alloy N-6 Test Data

| Milled Powder Properties | A | | | B | | | C | | |
|---|---|---|---|---|---|---|---|---|---|
| −325 Mesh, % | 51.7 | | | 69.7 | | | 83.8 | | |
| Fisher Size, μ | 11.6 | | | 7.9 | | | 6.1 | | |
| Blended With 5 Wt. % Elemental Ni Powder | | | | | | | | | |
| Fisher Size, μ | 10.5 | | | 7.4 | | | 5.7 | | |
| Sinterbonded Powder Properties | | | | | | | | | |
| 2 hr. at Sinterbonding Temp., °F. | 1800 | 1900 | 2000 | 1800 | 1900 | 2000 | 1800 | 1900 | 2000 |
| Fisher Size, μ | 12.2 | 15.0 | 20.0 | 9.0 | 9.8 | 15.3 | 7.4 | 8.3 | 11.7 |
| Apparent Particle Growth, μ | 1.7 | 4.5 | 9.5 | 1.6 | 2.4 | 7.9 | 1.7 | 2.6 | 6.0 |
| 50 Tsi Compacted Properties | | | | | | | | | |

TABLE 3-continued

| Alloy N-6 Test Data | | | | | | | | | |
|---|---|---|---|---|---|---|---|---|---|
| Green Density, % | 79.8 | 80.3 | 79.6 | 78.4 | 79.7 | 78.2 | 77.7 | 79.1 | 78.1 |
| Green Strength, psi | 720 | 910 | 2160 | 1015 | 1440 | 3090 | 1205 | 1770 | 3710 |

TABLE 4

| Alloy 711 Test Data | | | | | | | | | |
|---|---|---|---|---|---|---|---|---|---|
| Milled Powder Properties | A | | | B | | | C | | |
| −325 Mesh, % | 95.7 | | | 98.4 | | | 99.2 | | |
| Fisher Size, μ | 10.4 | | | 8.7 | | | 7.2 | | |
| Blended With 5 Wt. % Elemental Ni Powder | | | | | | | | | |
| Fisher Size, μ | 10.1 | | | 8.7 | | | 7.2 | | |
| Sinterbonded Powder Properties | | | | | | | | | |
| 2 hr. at Sinterbonding Temp., °F. | 1800 | 1900 | 2000 | 1800 | 1900 | 2000 | 1800 | 1900 | 2000 |
| Fisher Size, μ | 13.0 | 13.6 | 20.0 | 10.4 | 11.5 | 13.4 | 8.8 | 9.6 | 11.6 |
| Apparent Particle Growth, μ | 2.9 | 3.5 | 9.9 | 1.7 | 2.8 | 4.7 | 1.6 | 2.4 | 4.4 |
| 50 Tsi Compacted Properties | | | | | | | | | |
| Green Density, % | 69.7 | 70.6 | 71.7 | 69.7 | 70.4 | 70.4 | 69.5 | 69.9 | 70.0 |
| Green Strength, psi | 680 | 1010 | 1280 | 815 | 1240 | 1355 | 990 | 1360 | 1635 |

TABLE 5

| Alloy 106 Test Data | | | | | | | | | |
|---|---|---|---|---|---|---|---|---|---|
| Milled Powder Properties | A | | | B | | | C | | |
| −325 Mesh, % | 81.7 | | | 93.3 | | | 97.7 | | |
| Fisher Size, μ | 10.0 | | | 7.8 | | | 5.6 | | |
| Blended With 5 Wt. % Elemental Co Powder | | | | | | | | | |
| Fisher Size, μ | 8.0 | | | 6.7 | | | 5.1 | | |
| Sinterbonded Powder Properties | | | | | | | | | |
| 2 hr. at Sinterbonding Temp., °F. | 1800 | 1900 | 2000 | 1800 | 1900 | 2000 | 1800 | 1900 | 2000 |
| Fisher Size, μ | 10.6 | 14.9 | 18.0 | 8.3 | 12.0 | 15.0 | 6.7 | 10.0 | 14.0 |
| Apparent Particle Growth, μ | 2.6 | 6.9 | 10.0 | 1.6 | 5.3 | 8.3 | 1.6 | 4.9 | 8.9 |
| 50 Tsi Compacted Properties | | | | | | | | | |
| Green Density, % | 69.1 | 69.4 | 68.2 | 68.2 | 68.6 | 68.4 | 67.6 | 68.1 | 67.2 |
| Green Strength, psi | 145 | 220 | 350 | 175 | 335 | 410 | 240 | 450 | 600 |
| 10 Wt. % Co | | | | | 455 | | | | |
| 15 Wt. % Co | | | | | 520 | | | | |

TABLE 6

| Alloy 103 Test Data | | | | | | | | | |
|---|---|---|---|---|---|---|---|---|---|
| Milled Powder Properties | A | | | B | | | C | | |
| −325 Mesh, % | 92.8 | | | 96.5 | | | 98.8 | | |
| Fisher Size, μ | 10.2 | | | 9.6 | | | 7.3 | | |
| Blended With 5 Wt. % Elemental Co Powder | | | | | | | | | |
| Fisher Size, μ | 8.8 | | | 8.1 | | | 6.3 | | |
| Sinterbonded Powder Properties | | | | | | | | | |
| 2 hr. at Sinterbonding Temp., °F. | 1800 | 1900 | 2000 | 1800 | 1900 | 2000 | 1800 | 1900 | 2000 |
| Fisher Size, μ | 11.0 | 12.3 | 14.2 | 9.6 | 10.8 | 12.3 | 8.1 | 9.8 | 11.1 |
| Apparent Particle Growth, μ | 2.2 | 3.5 | 5.4 | 1.5 | 2.7 | 4.2 | 1.8 | 3.5 | 4.8 |
| 50 Tsi Compacted Properties | | | | | | | | | |
| Green Density, % | 67.6 | 67.1 | 66.9 | 66.4 | 66.3 | 66.3 | 65.7 | 65.8 | 65.5 |
| Green Strength, psi | 140 | 220 | 310 | 190 | 250 | 360 | 250 | 350 | 480 |
| 10 Wt. % Co | | | | | 460 | | | | |
| 15 Wt. % Co | | | | | 585 | | | | |

TABLE 7

| Alloy 587 Test Data | | | | | | | | | |
|---|---|---|---|---|---|---|---|---|---|
| Milled Powder Properties | A | | | B | | | C | | |
| −325 Mesh, % | 97.8 | | | 98.2 | | | 98.6 | | |
| Fisher Size, μ | 7.3 | | | 5.4 | | | 4.1 | | |
| Blended With 5 Wt. % Elemental Fe Powder | | | | | | | | | |
| Fisher Size, μ | 7.0 | | | 5.4 | | | 4.0 | | |
| Sinterbonded Powder Properties | | | | | | | | | |
| 2 hr. at Sinterbonding Temp., °F. | 1800 | 1900 | 2000 | 1800 | 1900 | 2000 | 1800 | 1900 | 2000 |

TABLE 7-continued

| Alloy 587 Test Data | | | | | | | | | |
|---|---|---|---|---|---|---|---|---|---|
| Fisher Size, μ | 8.1 | 8.7 | 10.4 | 6.5 | 7.1 | 8.5 | 5.2 | 5.9 | 7.4 |
| Apparent Particle Growth, μ | 1.1 | 1.7 | 3.4 | 1.1 | 1.7 | 3.1 | 1.2 | 1.9 | 3.4 |
| 50 Tsi Compacted Properties | | | | | | | | | |
| Green Density, % | 66.7 | 66.7 | 66.1 | 66.4 | 66.4 | 65.8 | 66.0 | 65.7 | 65.1 |
| Green Strength, psi | 400 | 490 | 500 | 540 | 650 | 570 | 630 | 840 | 830 |

What is claimed is:

1. The method of making a superalloy compact from a substantially noncompactable metal powder, comprising the steps of: providing a substantially noncompactable metal powder; optionally milling said powder: blending said powder with a softer metal-bearing powder; sinterbonding said blended powders; crushing said sinterbonded powders; and compacting said crushed powders said softer metal comprising an element required in the final superalloy.

2. The method of claim 1 wherein the softer metal-bearing powder is at least one of the group iron, cobalt and nickel.

3. The method of claim 1 wherein the softer metal-bearing powder one of the group iron carbonyl, cobalt carbonyl and nickel carbonyl.

4. The method of claim 1 wherein the sinterbonding step is conducted in an inert atmosphere at about 2000° F. for about 2 hours.

5. The method of claim 1 wherein the softer metal-bearing powder is within the range 1 to 25%.

6. The method of claim 1, wherein said substantially noncompactable metal powder is a prealloyed powder, and including the step of atomizing said powder from a melt thereof.

7. Superalloy powder made from a method comprising the steps of: providing a substantially noncompactable metal powder; optionally milling said powder; blending said powder with a softer metal-bearing powder; sinterbonding said blended powder; and crushing said sinterbonded powder said softer metal comprising an element required in the final superalloy.

8. The superalloy powder of claim 7 consisting essentially of, in weight percent, 9–11 cobalt, 11.5–13.5 iron, 25–27 chromium, 9–11 molybdenum, 9–11 tungsten, 2.1–2.7 carbon, up to 1 silicon, up to 0.75 manganese, up to 1 boron and the balance nickel and incidental impurities.

9. The superalloy powder of claim 7 consisting essentially of, in weight percent, chromium 29 to 33, tungsten 11 to 14, carbon 2 to 2.7, iron and nickel up to 3 each, silicon, manganese and boron up to 1 each, and the balance cobalt and incidental impurities.

10. The superalloy powder of claim 7 consisting essentially of, in weight percent, chromium 23 to 26, molybdenum 15 to 17, carbon 2.6 to 3.1, boron 0.5 to 0.75 up to 0.5 manganese, nickel and cobalt up to 3 each, and the balance iron plus incidental impurities.

* * * * *